US005270786A

United States Patent [19]

Kikuchi et al.

[11] Patent Number: 5,270,786

[45] Date of Patent: Dec. 14, 1993

[54] DEVELOPING DEVICE USING DEVELOPING ROLLER HAVING SPECIFIC STRUCTURE

[75] Inventors: Kazuhiko Kikuchi; Naruhito Yoshida, both of Kanagawa, Japan

[73] Assignee: Kabushiki Kaisha Toshiba, Kawasaki, Japan

[21] Appl. No.: 708,880

[22] Filed: May 31, 1991

[30] Foreign Application Priority Data

May 31, 1990 [JP] Japan ..... 2-142956

[51] Int. Cl.[5] ..... G03G 15/06

[52] U.S. Cl. ..... 355/261; 118/651; 492/53

[58] Field of Search ..... 355/259, 261; 118/651, 118/661; 29/130, 132; 492/53, 56

[56] References Cited

U.S. PATENT DOCUMENTS

| | | | |
|---|---|---|---|
| 3,152,012 | 10/1964 | Schaffert | 118/637 |
| 4,827,868 | 5/1989 | Tarumi et al. | 355/259 X |
| 4,883,715 | 11/1989 | Kuge et al. | 29/132 X |
| 4,899,689 | 2/1990 | Takeda et al. | 118/651 |
| 4,958,193 | 9/1990 | Nojima et al. | 355/259 |
| 4,967,231 | 10/1990 | Hosoya et al. | 355/259 X |
| 4,994,319 | 2/1991 | Nojima et al. | 355/259 X |

FOREIGN PATENT DOCUMENTS 1-252979 10/1989 Japan .
2-259785 10/1990 Japan .

OTHER PUBLICATIONS

Hosoya et al., "Contact-Type Development System Using Monocomponent nonmagnetic Toner," Toshiba R&D Center, pp. 25-28.

*Primary Examiner*—A. T. Grimley
*Assistant Examiner*—Robert Beatty
*Attorney, Agent, or Firm*—Foley & Lardner

[57] ABSTRACT

A device for developing a latent image on an image carrier is used in an image forming apparatus. The developing device includes a developing roller, located to contact with the image carrier, for supplying a developing agent to the image carrier, and a blade, located to face the developing roller, for forming a developing agent layer of the developing agent supplied to the image carrier on the developing roller. The developing roller comprises an urethane rubber layer and a conductive urethane resin layer located around the rubber layer, in which the thickness T [μm] of the conductive resin layer satisfies the formula, $3 \times Rz = T = 100$ when the maximum surface roughness of the rubber layer is taken in Rz [μm]. in addition, the respective elongations (%) of the rubber and resin layers $L_e$ and $L_1$, satisfy the formula $L_e - L_1 \leqq 200$.

5 Claims, 5 Drawing Sheets

DEVELOPING DEVICE USING DEVELOPING ROLLER HAVING SPECIFIC STRUCTURE

BACKGROUND OF THE INVENTION

1. Field of the Invention

The present invention relates to a developing device in which an electrostatic latent image formed on an image carrier is converted into a visible image in an image forming apparatus such as an electrophotographic apparatus or electrostatic recording apparatus 2. Description of the Related Art 'Impression development' is known as one of the developing methods which uses one-component developing agent. This method has the characteristic of causing the toner particles or the toner carrying member to come into contact with the electrostatic latent image at essentially zero relative peripheral speed, as shown in U.S. Pat. No. 3,152,012. Since no magnetic materials are required, this has many advantages such as making the apparatus capable of simplification and being made more compact while, at the same time, making coloring of the toner simple.

In the above impression development method, since developing is performed by pressing the toner carrying member on, or bringing it into contact with, the electrostatic latent image, the use of a developing roller which has elasticity and conductivity as the toner carrying member becomes necessary. In particular, when the electrostatic latent image bearing member is rigid, it is a vital condition that the developing roller should be composed of an elastic body to avoid damage to the latent image bearing member. Also, in order to obtain the already-known developing electrode effect or the bias effect, it is desirable to provide a conductive layer on the surface, or in the vicinity of the surface, of the developing roller, and to apply a bias voltage as required.

However, because, in this type of developing device which uses a developing roller, developing is performed by the pressure contact of the electrostatic latent image bearing member and a blade for the formation of a toner thin layer with the developing roller, the following problem occurs.

That is, a certain length of time is required for the full recovery of the conductive layer of the developing roller which is deformed by the pressure contact of the electrostatic latent image bearing member and the toner thin layer formation blade. Because of this, a state may occur in which developing is performed before full recovery from this deformation and this will result in image randomness at every single rotation of the developing roller.

In this way, in developing apparatus which used the impression development method hitherto, the surface of the developing roller was deformed due to the pressure contact with the electrostatic latent image bearing member and the developer thin layer formation means, and this deformed portion reached the developing area before it had fully recovered. As a result, there was a problem in that there was great deterioration of image quality due to the occurrence of density randomness and fogging.

SUMMARY OF THE INVENTION

It is an object of the present invention to provide a developing device which is capable of obtaining high-quality images without any defects such as density randomness and fogging and, at the same time, is capable of maintaining high image quality, even when used for long periods.

According to the present invention there is provided a developing roller used for supplying a developing agent to an image carrier, comprising an elastic layer for obtaining a predetermined nip width between the developing roller and the image carrier; and a conductive layer on the elastic layer for charging the developing agent, the conductive layer having a thickness T [μm] which satisfies the formula, $3 \times Rz \leqq T \leqq 100$ when the maximum surface roughness of the elastic layer is taken in Rz [μm].

Further according to the present invention there is provided a device for developing a latent image on an image carrier, comprising roller means, located to contact with the image carrier, for supplying a developing agent to the image carrier; and means for forming a developing agent layer of the developing agent supplied to the image carrier on the roller means; the roller means comprising an elastic layer and a conductive layer locate d around the elastic layer, in which the thickness T [μm] of the conductive layer satisfies the formula, $3 \times Rz \leqq T \leqq 100$ when the maximum surface roughness of the elastic layer is taken in Rz [μm].

BRIEF DESCRIPTION OF THE DRAWINGS

FIG. B is a graph showing the relationship between the thickness of the conductive layer formed by Dipping Method and the surface roughness of the developing roller.

DETAILED DESCRIPTION OF THE PREFERRED EMBODIMENT

Referring to the accompanying drawings, a detailed description will subsequently be given of the preferred embodiment of the present invention.

Figure 1:
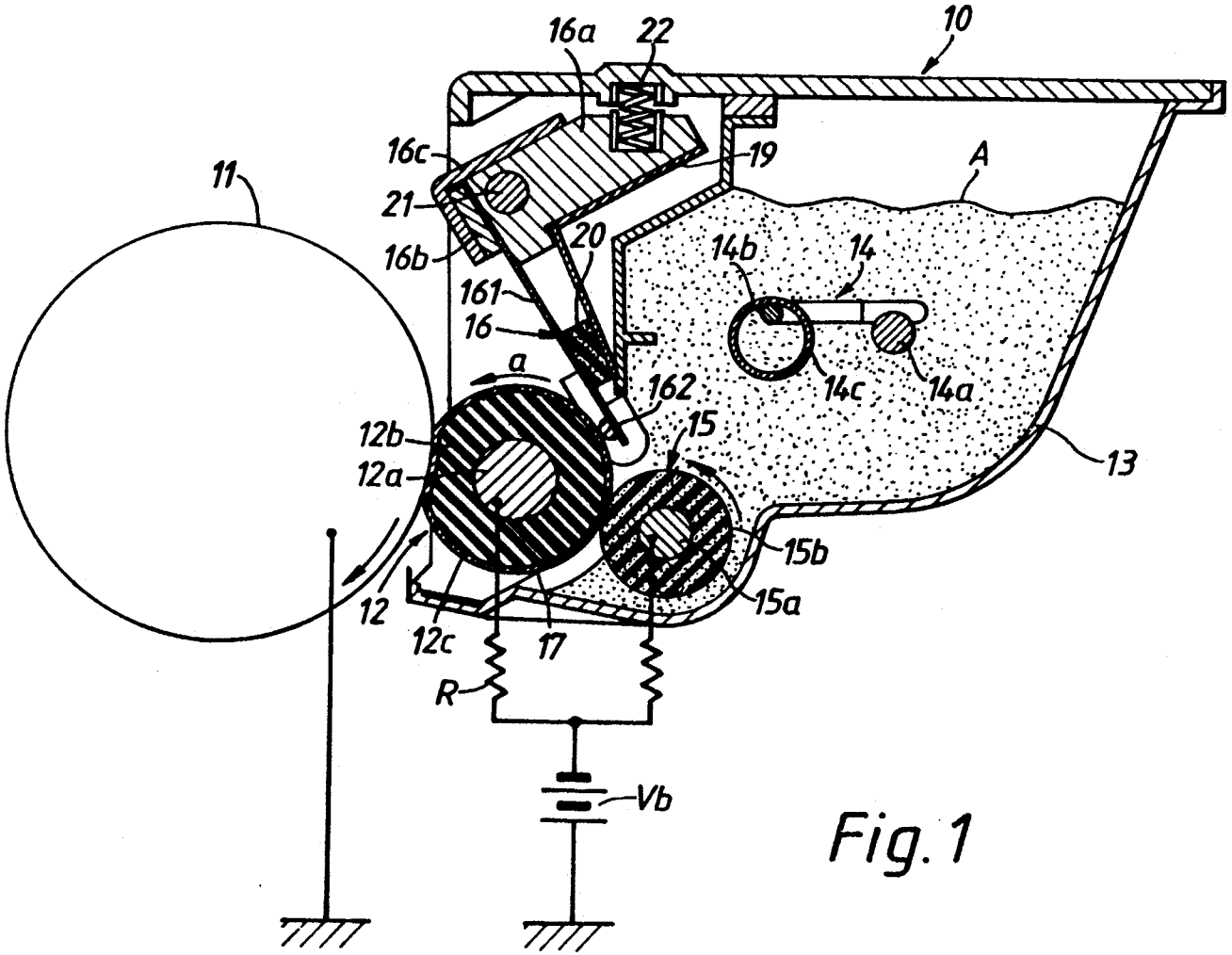
FIG. 1 is a cross-section view showing the overall composition of the developing device of an embodiment of the present invention.

FIG. 1 is a cross-section view showing the overall composition of a contact type one-component non-magnetic developing device (hereafter, simply 'developing device') which is an embodiment of the present invention.

As shown in FIG. 1. developing device 10 comprises developing roller 12, toner storage 13, mixer 14, toner supply roller 15 and blade 16. Developing roller 12 converts an electrostatic latent image into a visible image by transferring non-magnetic toner (hereafter, simply 'toner') A as a developing agent on to the electrostatic latent image formed on the surface of photosensitive drum 11. Toner storage 13 contains toner A. Mixer 14 is arranged in toner storage 13 to agitate toner A for supplying toner A toward supply roller 15 and preventing the coagulation of toner A. Mixer 14 comprises rotational axis 14*a*, mounting bar 14*b* fixed to rotational axis 14*a* and coil spring 14*c* mounted to mounting bar 14*b*. Toner supply roller 15 supplies toner A, which is stored in toner storage 13, to developing roller 12. Blade 16 forms a toner thin layer on the surface of developing roller 12.

The developing process in developing device 10 will now be described.

Toner A stored in toner storage 13 is transported in the direction of toner supply roller 15 while being agitated by mixer 14, and is then supplied to developing roller 12 by toner supply roller 15. Toner A is negatively charged by friction with the surface of rotating developing roller 12 and is transported by being electrostatically adsorbed to the surface of developing roller 12. Then, the amount of toner A which is adsorbed to the surface of developing roller 12 and transported is regulated by blade 16 and is formed into a thin layer. At the same time, toner A is recharged by the friction between developing roller 12 and blade 16, and is transported as a fine toner later. After this, toner A adsorbed to the surface of developing roller 12 is transferred to the electrostatic latent image on the surface of photosensitive drum 11 by contact with photosensitive drum 11. By this means, the electrostatic latent image is converted into the visible image. Any toner A on the surface of developing roller 12 which has not been transferred passes through between recovery blade 17 and the surface of developing roller 12 and returns to toner storage 13.

In this embodiment, since the reversal development technique which uses negatively-charged organic photosensitive drum 11 is adopted, negatively-charged toner is used as toner A, and a material which easily negatively charges toner A is used as blade 16. The surface potential of photosensitive drum 11 is −550V. As against this, developing bias voltage Vb of −200V is applied to metallic shaft 12*a* of developing roller 12 via protective resistor R. Developing roller 12 always has a contact width (developing nip) Of about 1–5 mm On the surface of photosensitive drum 11, and developing roller 12 rotates at a speed of approximately 1–4 times the speed of rotation of photosensitive drum 11.

Blade 16 is supported on the device main body by first blade holder 16*a*, spacer 16*b* and second blade holder 16*c*. Baffle plate 19 is mounted on first blade holder 16*a* to sandwich foaming agent 20, such as moltopren, between this baffle plate 19 and the rear surface of blade 16. By sandwiching foaming agent 20 between baffle plate 19 and blade 16 in this way, leaks of toner A from toner storage 13 and vibration of blade 16 are prevented.

In order to press with suitable force the surface of developing roller 12 with its leading edge or tip 162, blade 16 is always energized by multiple compression springs 22, using rotating shaft 21 as a fulcrum. The spring constant of these compression springs 22 is lower than the spring constant of blade 16 (thin plate spring material 161). Therefore, even if tip 162 wears, there is almost no change in its pressure force.

Figure 2:
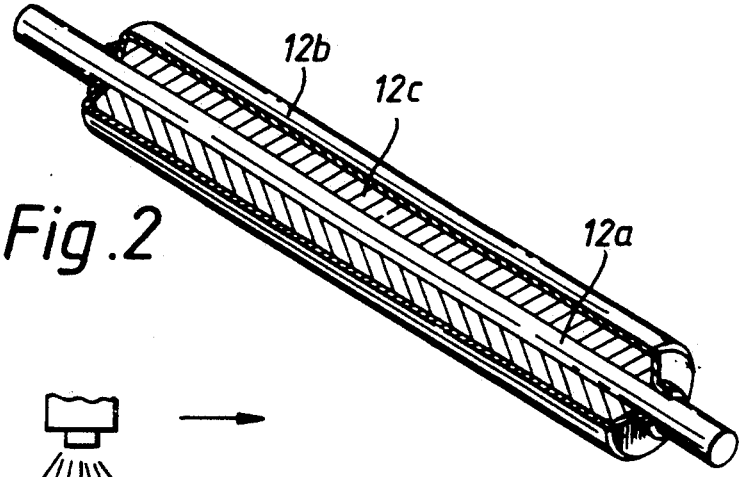
FIG. 2 is an oblique Cross-section view to illustrate the structure of the developing roller in the developing device in FIG. 1.

A derailed description of developing roller 12 will now be described with referring to FIG. 2.

The characteristic required for developing roller 12 is "to have conductivity and elasticity". As the simplest structure which will satisfy this, for example, a conductive rubber roller covering the outer periphery of a metal shaft can be cited. However, in the developing device of this embodiment, smoothness of the surface is required because the toner is transported while in pressure contact with the surface of developing roller 12. Therefore, developing roller 12 of this embodiment has a two-layer construction by providing elastic layer 12*b* made of urethane rubber around the periphery of metallic shaft 12*a* as a base member, and further providing conductive polyurethane type layer 12*c* on the surface of this elastic layer 12*b*.

Conductive layers or non-conductive layers may be considered as elastic layer 12*b*. However, a conductive layer is preferable when taking account of the case of peeling or damage occurring in conductive layer 12*c*.

The rubber hardness of elastic layer 12*b* is an essential factor which has a direct influence on the load and the torque of developing roller 12 in order to give a suitable nip width between developing roller 12 and photosensitive drum 11. In addition permanent deformation [%]noted in JIS K6301 due to packaging and long-time holding is a significant problem. If the deformation exceeds 10%, a density non-uniformity due to developing roller cycles appears on images. Thus, the compression permanent deformation [%]of elastic layer 12*b* must be limited to 10% or less, and preferably 5% or less. The relationship between the rubber hardness and the permanent deformation has the general tendency that the higher the rubber hardness, the less the permanent deformation. Therefore, a mutual balance with the material becomes important Also what becomes a particular problem here is the speed of recovery of the deformation of the surface of developing roller 12 created by contact pressures with photosensitive drum 11 and blade 16. When developing is carried out in a state in which the deformation still remains, density randomness and fogging will easily occur, and the image quality will greatly deteriorate.

As a countermeasure, when packaging, and in the state before developing device 10 is installed in the image forming apparatus, the method of keeping photosensitive drum 11 and blade 16 in positions separated from developing roller 12 may be considered.

However, after developing device 10 is housed in the image forming apparatus and the toner is housed in toner storage 13, although photosensitive drum 11 may be withdrawn to a position separated from developing roller 12 when it is not operating, blade 16 cannot be moved from its set position, since it has the role of keeping the toner inside toner storage 13.

For this reason, concerning the deformation of the surface of developing roller 12 by pressure contact with blade 16, it is required that, when the image forming apparatus commences the first print from the ready state, the residual deformation must recover, for instance, to less than 10 μm within 10 sec, within the time from commencement of rotation of developing roller 12 to the actual commencement of developing.

Figure 3:
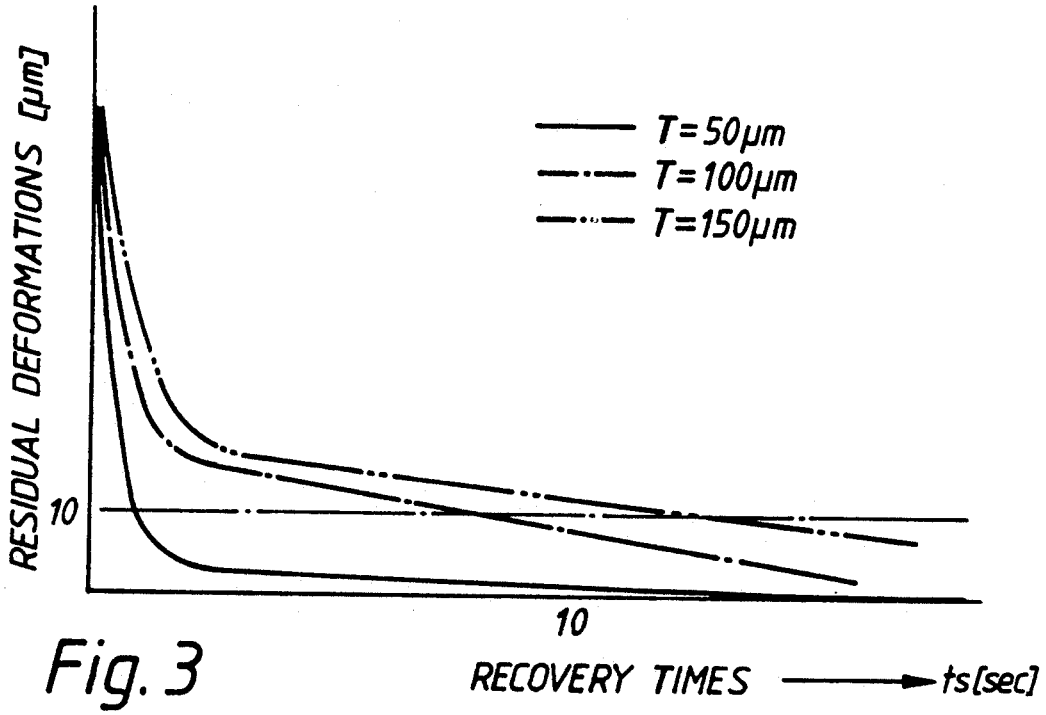
FIG. 3 is a graph showing the relationship between the thickness of the conductive layer and the recovery speed of deformation.

FIG. 3 is a graph showing the relationship between the respective residual deformations and the recovery times for 3 types of developing roller with differing film thicknesses T [μm] of conductive layer 12*c*.

From FIG. 3, if the elastic layers 12*b* are the same, the residual deformation [μm] will depend on the film thickness T [μm] of conductive layer 12*c*, and it is understood that the condition of "residual deformation of less than 10 μm in less than 10 sec" can be satisfied if film thickness T [μm] of conductive layer 12c is less than 100 μm.

Since conductive layer 12c contacts with the toner and photosensitive drum 11 directly, the layer 12c must be prevented from contaminating the toner and photosensitive drum 11 owing to exudation of plasticizer, curing agent, process oil, etc. It is desirable that the maximum surface roughness should be less than 3 μm for the smoothness of the surface of conductive layer 12c. If the surface roughness is greater than this value, the roughness of the surface of layer 12c is liable to appear on images as the unevenness patterns.

As a method of achieving a smoothness of conductive layer 12c which is less than the maximum surface roughness of 3 μm, the method of attaching a conductive layer 12c having sufficient film thickness on elastic layer 12b and then finishing it to the specified outer diameter and surface roughness by after-treatment (polishing) may be considered. However, this method would be costly. Therefore, a method of finishing without requiring after-treatment is desired. For this purpose, the viscosity of coating for the surface roughness of elastic layer 12b, the film thickness of conductive layer 12c and the formation of conductive layer 12c must be selected at the optimum condition. That is, the lower the viscosity of the coating and the greater the surface roughness of elastic layer 12b, the greater must be the film thickness of conductive layer 12c.

Concerning the coating for forming conductive layer 12c, the viscosity must be changed by varying the amount of dilution, even when the same coating is used, depending on the method of coating on the surface of elastic layer 12b.

Figure 4:
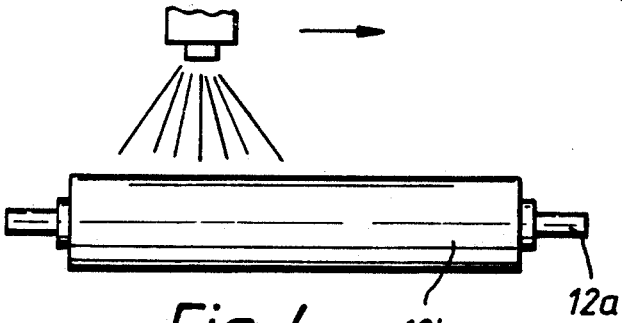
FIGS. 4 to 6 are schematic views to illustrate respective methods of forming the conductive layers of developing rollers.
Figure 5:
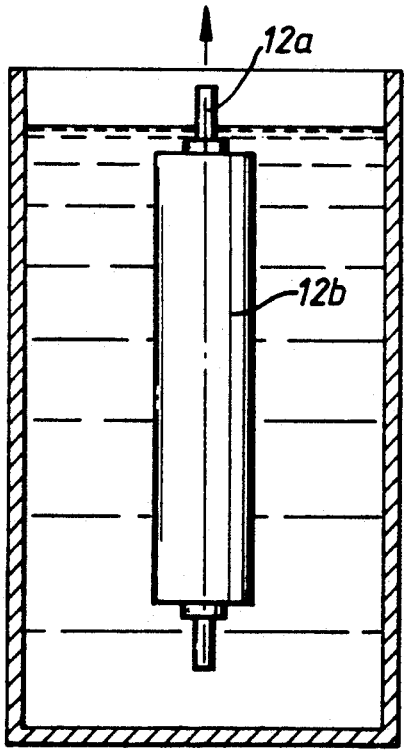
Figure 6:
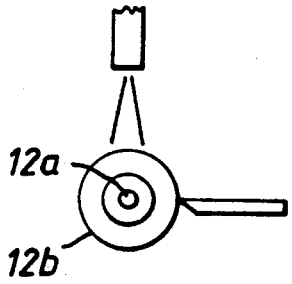

FIG. 4 to 6 show representative coating methods for the conductive layer coating material.

FIG. 4 is a spray coating method, FIG. 5 is a dipping method and FIG. 6 is a knife-edge coating method.

The viscosities of the coatings in the respective coating methods are Spray Method < Dipping Method ≦ Knife-Edge Method. The film thickness T [μm] of the required coat to achieve the smoothness (maximum surface roughness 3 μm) of the surface of conductive layer 12c can be obtained, provided the maximum surface roughness of elastic layer 12b is taken as Rz [μm], when $T \geqq 5 \times Rz$ in the spray method and $T \geqq 3 \times Rz$ in the dipping method and the knife-edge method are satisfied.

Therefore, for the film thickness T [μm] of conductive layer 12c, if the time from commencement of rotation of developing roller 12 to the time of commencement of developing is taken as ts [sec] when the image forming apparatus commences at first print from the ready state, provided $3 \times Rz \leqq T \leqq 100$ is satisfied when 023 $ts \leqq 10$, a high image quality can be maintained, and a low-cost developing roller 12 can be produced.

Figure 8:
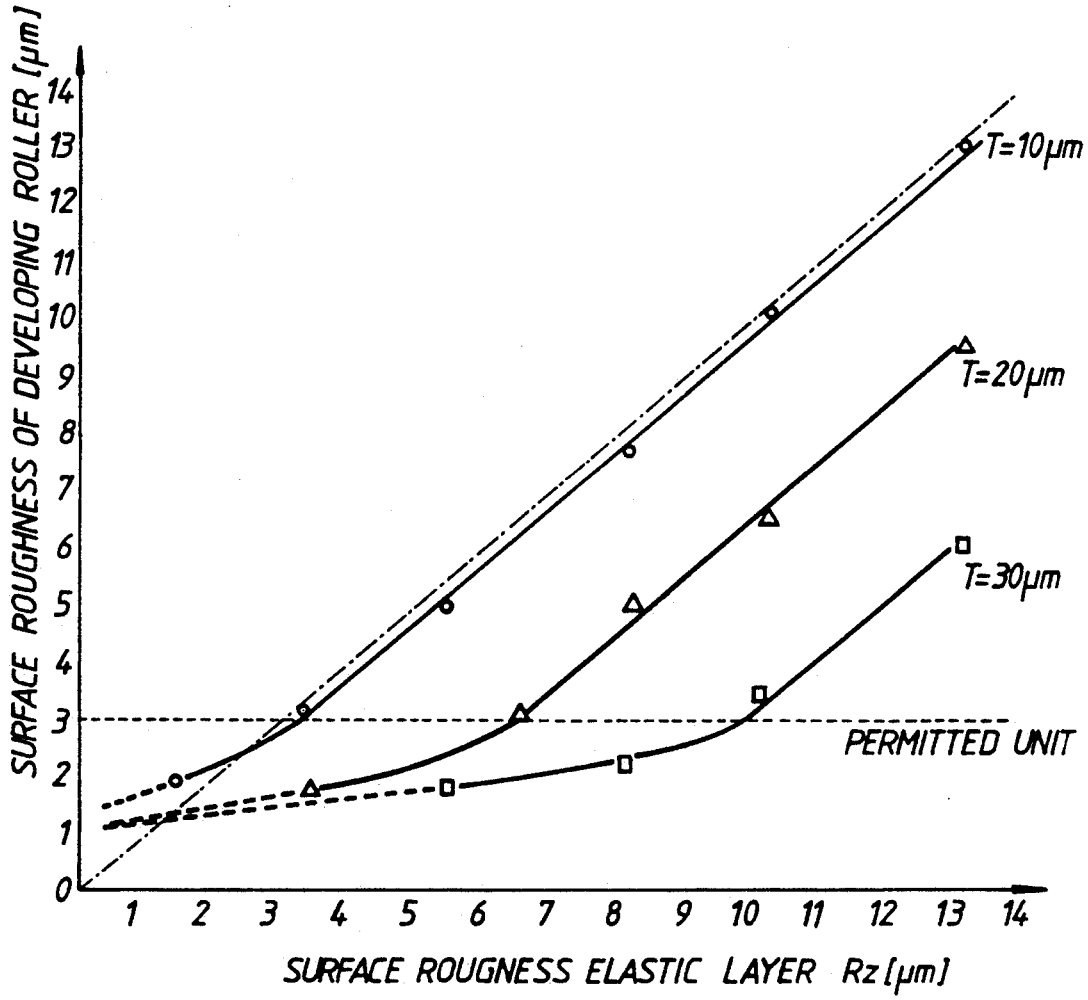

FIG. 8 shows the relationship between the thickness of the conductive layer formed by Dipping Method and the surface roughness of the developing roller. If the thickness T [μm] of the conductive layer is relatively small (for example, T = 10 μm), the surface roughness of the developing roller nearly agree with the surface roughness of the elastic layer. According as the thickness T [μm] of the conductive layer increases, the surface roughness of the developing roller is in proportion to the surface roughness of the elastic layer when the surface roughness of the elastic layer is greater than the prescribed surface roughness (3 [μm]) of the developing roller. In the developing device of the present invention, developing roller 12 contacts with the surface of photosensitive drum 11. Therefore, if the surface roughness of developing roller 12 is greater than the prescribed surface roughness, the roughness of developing roller 12 is unfortunately liable to appear on images especially on solid images) as unevenness patterns. By the various experimentations in which the thickness of the conductive layer is varied respectively, it becomes clear that the roughness of developing roller 12 has no adverse effect on the images when the thickness of the conductive layer is less than 3 [μm]. Therefore, in order to make the surface roughness of developing roller 12 is less than 3 [μm], it is desirable that the surface roughness of the elastic layer should be lesser. However, it is difficult and costly to polish the elastic material (rubber material) of the elastic layer with high accuracy. Thus the regulation is required by the thickness T [μm] of the conductive layer of developing roller 12 to make the surface roughness of developing roller 12 is less than 3 [μm].

Figure 9:
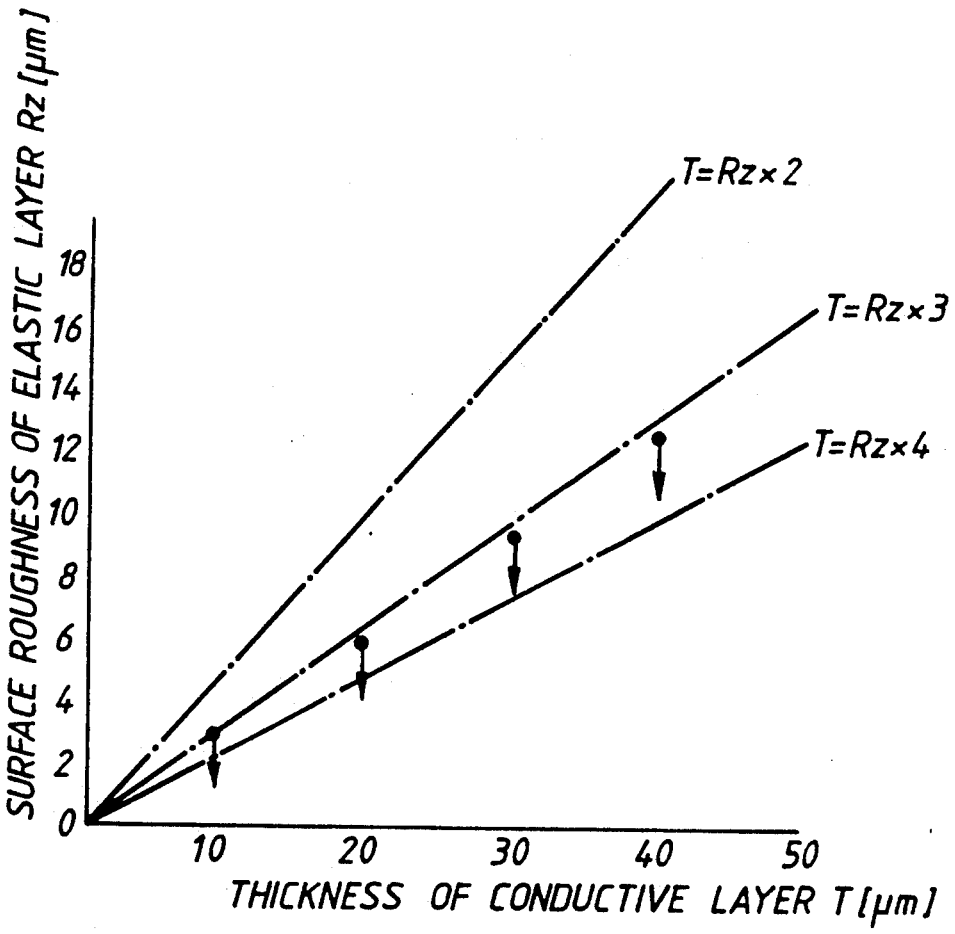
FIG. 9 is a graph showing the relationship between the surface roughness of the elastic layer and the thickness of the conductive layer when the surface roughness o f the developing roller is less than 3 [μm] .

FIG. 9 shows the relationship between the surface roughness of the elastic layer and the thickness of the conductive layer when the surface roughness of the developing roller is less than 3 [μm]. As shown in this FIG. 9, the surface roughness of developing roller 12 being less than 3 [μm] is achieved when the thickness T [μm] of the conductive layer is greater than 3 (three) times of the surface roughness Rz [μm] of elastic layer. By this means, high-quality of images can be obtained without defective images.

In addition, the elongation [%] itself of conductive layer 12c itself is important. If the extension is less than 50%, conductive layer 12c cannot follow the elastic deformation of elastic layer 12b, and cracks are liable to occur at both ends with particularly large elastic deformation. Moreover, if the difference between the elongation [%] the material of elastic layer 12b and the elongation [%] of the material of conductive layer 12c is less than 200, that is, if it does not satisfy $L_e - L_l \leqq 200$ (where $L_e$ and $L_l$ denote the respective elongations [%]), conductive layer 12c cannot follow the elastic deformation of elastic layer 12b, and cracks will occur in conductive layer 12c. If this formula is not satisfied, the recovery of the developing roller 12 after deformation is slow and the elastic hardness of developing roller 12 increases. Thus, a density variation is liable to occur over a single rotation of developing roller 12

Figure 7:
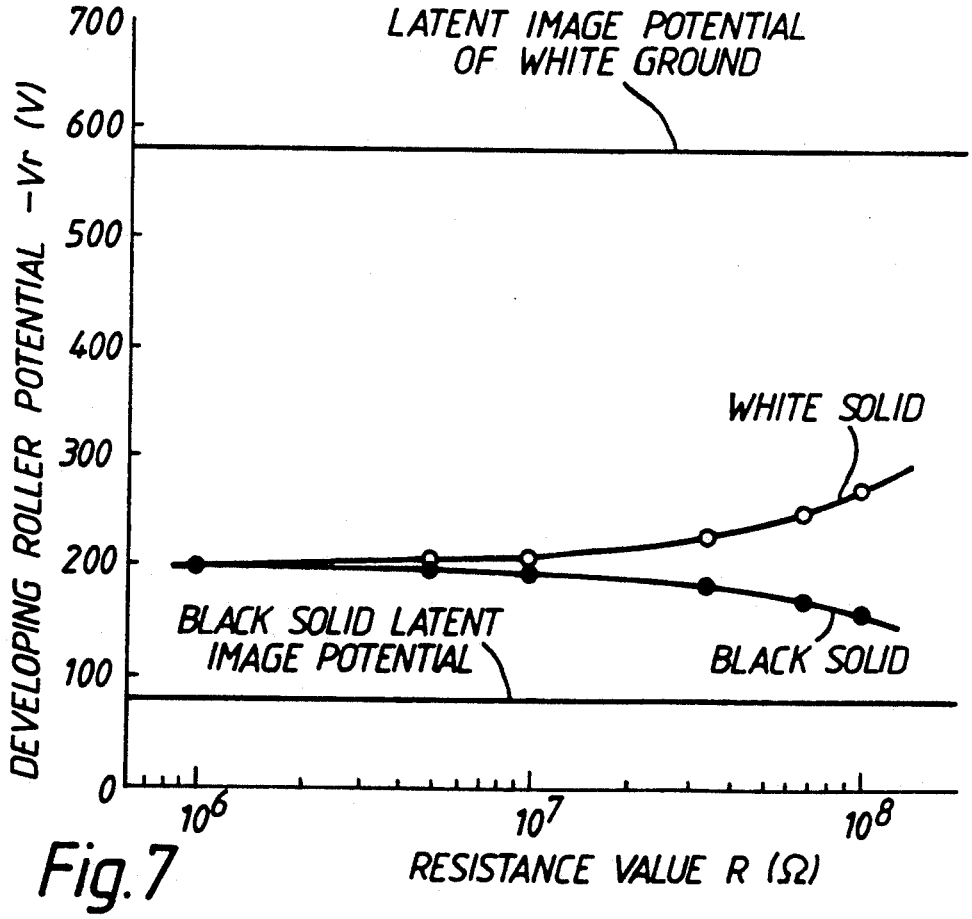
FIG. 7 is a graph showing the relationship between the surface potential and the resistance value of the developing roller and the image.

Furthermore, for conductive layer 12c a material is required which is easily positively charged by friction, because the toner is negatively charged in this embodiment, and the toner transportability must be excellent. Regarding the resistance between metallic shaft 12a and the surface of conductive layer 12c, which is a characteristic of developing roller 12, a resistance of a given resistance is interposed between developing bias voltage Vb and metallic shaft 12a for the purpose of experiments of development. Thus, the relationship between the surface potential of the developing roller and images was found, which is shown in FIG. 7. The voltage of the developing bias voltage Vb at this time was −200 V.

As is obvious from FIG. 7, where the resistance value of the resistor interposed between the developing bias voltage Vb and metallic shaft 12a is $10^7$ Ω or more, developing roller 12 has different surface potentials at the time of developing a white solid image and a black solid image. The surface potential tends to approach a white ground latent image potential in the white solid image, and to approach a black solid latent image potential at the black solid image. In other words, in the case of an image having a large-area image part, the difference between the image-part latent image potential and the developing roller surface potential is decreased, resulting in an image with a low density. By contrast, in the case of a fine-line image or the like having a small-area image part, the developing roller surface potential approaches a white ground latent image potential and the potential difference between the roller surface potential and the image part potential increases. Thus, a fine line thickens, resulting an unclear image.

The fluctuation in surface potential of developing roller 12 is due to a Current flowing through the resistor during development. At the time of developing a black solid image, negatively charged toner particles are transferred from developing roller 12 to photosensitive drum 11. Thus, an electric current is caused to flow from developing roller 12 to developing bias voltage Vb. At the time of developing a total white image, the surface charge on photosensitive drum 11 is eliminated, and an electric current is caused to flow from developing bias voltage Vb to developing roller 12. A potential difference occurs at both ends of the resistor due to this type of current, and fluctuation of the developing roller surface potential as described above will occur.

This tendency was particularly marked at resistance values of $1\times10^8\ \Omega$ or more. From this face, it is confirmed that good images ca be obtained when the actual resistance value between metallic shaft 12*a* and conductive layer 12*c* is less than $1-10^9\ \Omega$ or, preferably, less than $1\times10^7\ \Omega$.

However, since there is actually a bonding layer or a primer treated layer existing between metallic shaft 12*a* and elastic layer 12*b* , it is necessary to reduce the resistance below this.

In this embodiment, good results, were obtained by making the respective resistance values of elastic layer 12*b* and conductive layer 12*c* less than $1\times10^6\ \Omega\cdot$cm.

From the above facts, in developing roller 12 of this embodiment, conductive urethane rubber with rubber hardness (JIS-A) less than 35°, elongation about 250–500% and resistance value less than $1\times10^6\ \Omega\cdot$cm was used. A conductive polyurethane coating, for instance, "Sparex" (trade name) (manufactured by Nippon Miracton Co., Ltd.), with resistance $10^4-10^5\ \Omega\cdot$cm and elongation about 100–400% was used for conductive layer 12*c*. As a result, the rubber hardness for developing roller 12 as a whole was about 30–50°. Also, a developing roller 12 with maximum surface roughness 3 μm was achieved bV forming conductive coating on elastic layer 12*b* with a surface roughness of 5–10 μm. By this means, a developing roller 12 which has a good recovery speed for deformation and is capable of obtaining high-quality image s was achieved.

The following is a description of toner supply roller 15.

Toner supply roller 15 has the function of supplying toner to developing roller 12 and the function of scraping residual toner from developing roller 12 after development. Toner supply roller 15 is constituted such that a soft polyurethane foamed layer 15*b* having an electrical conductivity of $10^6\ \Omega\cdot$cm or less, a density of 0.045 g/cm$^2$ and a cell number of about 50–60 cells/25 mm is formed around metallic shaft 15*a*. The depth of contact of toner supply roller 15 with developing roller 12 is about 0.2–1.0 mm, and the rotational speed of toner supply roller 15 is ½ of or equal to that of developing roller 12, with the directions of rotation reverse to each other. Bias voltage Vb of a potential equal to that applied to developing roller 12 is applied to toner supply roller 15.

In this way, when applying the developing device of this embodiment, by setting the layer thickness T [μm] of conductive layer 12*c* of developing roller 12 within limits which satisfy $3\times Rz\leqq100$, when taking the maximum surface roughness of the elastic layer 12*b* as Rz [μm], a developing roller can be achieved which has the required smoothness as conductive layer 12*c* and has sufficient recovery speed in performance for the deformation of the developing roller surface due to the pressure contact with photosensitive drum 11 and blade 16. As a result, a developing device can be achieved which is capable of producing high-quality images without density randomness and fogging, and which can also respond to the requirements for long life and high speed copying operation.

In this embodiment, metallic shaft 12*a* was used as a supporting shaft of developing roller 12. However, provided the developing bias voltage can be supplied, a conductive resin shaft, for instance, may be used. Also, in the type of developing roller which supplies a developing bias voltage to conductive layer 12*c* or elastic layer 12*b*, there is no requirement for the supporting shaft to be conductive and therefore an insulating material may be used.

Moreover, blade 16 is supported in a position 'against' the rotation of developing roller 12, but it may also be supported in a position 'with' the rotation of developing roller 12.

Furthermore, in this embodiment, contact non-magnetic one-component developer is used. However, it is not limited to this, and non-contact developing agent with, for instance an Ac or a DC bias may also be used.

According to the present invention, a developing roller can be achieved which has sufficient recovery speed in performance for the deformation of the developing roller surface by pressure contact with the electrostatic latent image carrier and the developer thin layer formation device. By this means, a developing device can be achieved which is capable of producing high-quality images without density randomness and fogging, and which can also respond to the requirements for long life and high speed image forming operation.

What is claimed is:

1. A developing roller used for supplying a developing agent to an image carrier, comprising:

an elastic layer made of urethane rubber for obtaining a predetermined nip width between the developing roller and the image carrier; and a conductive layer made of urethane resin coated on the elastic layer for charging the developing agent;

wherein the conductive has a thickness T (μm) which satisfies the formula, $$3\times Rz\leqq T\leqq100$$

when the maximum surface roughness of the elastic layer is Rz (μm), and the elastic layer and the conductive layer satisfy the formula, $$L_e-L_l\leqq200$$

where $L_e$ and $L_l$ denote the respective elongations (%) of the materials thereof.

2. The developing roller of claim 1, wherein the elastic layer has a compression permanent deformation [%] in the range of 10% or less.

3. A device for developing a latent image on an image carrier, comprising:

roller means, located to contact with the image carrier, for supplying a developing agent to the image carrier; and means for forming a developing agent layer of the developing agent supplied to the image carrier on the roller means;

the roller means comprising an elastic layer made of urethane rubber and a conductive layer made of urethane resin coated on the elastic layer, in which the thickness T (μm) of the conductive layer satisfies the formula, $$3 \times Rz \leqq T \leqq 100$$

when the maximum surface roughness of the elastic layer is Rz (μm), and the elastic layer and the conductive layer of the roller means satisfy the formula, $$L_e - L_l \leqq 200$$

where $L_e$ and $L_l$ denote the respective elongations (%) of the materials thereof.

4. The device of claim 3, wherein the elastic layer of the roller means has a compression permanent deformation [%] in the range of 10% or less.

5. A developing roller used for supplying a developing agent to an image carrier, comprising:

an elastic layer made of urethane rubber for obtaining a predetermined nip width between the developing roller and the image carrier; and a conductive layer made of urethane resin coated on the elastic layer for charging the developing agent;

wherein the conductive layer has a thickness T (μm) which satisfies the formula, $$3 \times Rz \leqq T \leqq 100$$

when the maximum surface roughness of the elastic layer is taken in Rz (μm), the elastic layer and the conductive layer satisfy the formula, $$L_e - L_l \leqq 200$$

where $L_e$ and $L_l$ denote the respective elongations (%) of the materials thereof, and the elastic layer and the conductive layer respectively have a resistance value of less than $1 \times 10^6$ (Ω·cm).

* * * * *